United States Patent [19]

Frechmann et al.

[11] 3,935,597

[45] Feb. 3, 1976

[54] WEARING APPAREL HOOD

[76] Inventors: Edmee G. Frechmann; Theresa G. Depret, both of 9804 E. 25th St. Terrace, Independence, Mo. 64052

[22] Filed: Apr. 14, 1975

[21] Appl. No.: 567,743

[52] U.S. Cl. ..... 2/207; 2/91

[51] Int. Cl.[2] ..... A42B 5/00

[58] Field of Search ..... 2/91, 207, 208, 209, 209.1, 2/175, 195, 198, 201

[56] References Cited

UNITED STATES PATENTS

| | | | |
|---|---|---|---|
| 2,462,727 | 2/1949 | Danelz | 2/91 |
| 2,464,007 | 3/1949 | Towle | 2/91 |
| 3,231,900 | 2/1966 | Gettinger | 2/207 |

*Primary Examiner*—G. V. Larkin

*Attorney, Agent, or Firm*—Fishburn, Gold & Litman

[57] ABSTRACT

An article of wearing apparel adapted for use as a tie, scarf, neck-piece, hood, belt, or the like, is formed of an elongated fabric member having an intermediate portion and opposite end portions joined together by a respective pair of first and second fabric portions or layers connected at spaced points to define passages therebetween. The first and second fabric portions of each pair are each of a width substantially less than a width of the intermediate portion and the opposite end portions whereby when one of the end portions has been moved through the passage adjacent the other end portion, fabric portions resist attempts to pull the one end portion through said passage.

5 Claims, 7 Drawing Figures

WEARING APPAREL HOOD

The present invention relates to an article of wearing apparel adapted for use as a tie, scarf, neck-piece, hood, belt, or the like, and more particularly to such an article of wearing apparel having transversely extending passages between respective end portions and an intermediate portion of an elongated fabric member.

The principal objects of the present invention are: to provide an article of wearing apparel having a fastening means eliminating requirement for ties, snaps, buttons, pins, interengaging fastening tapes, and the like; to provide such an article of wearing apparel adapted for use as a tie, scarf, neck-piece, hood, arm-band, accent piece, belt, or the like; to provide such an article of wearing apparel having an intermediate portion and opposite end portions joined by facing fabric portions defining transversely extending passages whereby one passage permits the end portion and fabric portions at the other end to be moved therethrough for use; to provide such an article wherein the passage is defined by plies or flat layers of the fabric that are substantially parallel whereby the passage is transversely of the width of said fabric layers; to provide such an article of wearing apparel wherein the intermediate portion and opposite end portions each have a greater width than the width of the fabric portions defining the passages whereby one of the end portions of the fabric member resists separation by being moved through the passage adjacent the other end portion; to provide such an article of wearing apparel wherein the length and width of the passage defining layer or layers are substantially equal; to provide such an article of wearing apparel wherein the intermediate portion has a length such that the article is free moving and comfortable to wear when around the neck of a person and without a feeling of strangulation; to provide such an article of wearing apparel including a back panel attached to one side edge of the intermediate portion to define a hood; and to provide such an article of wearing apparel which is attractive in appearance, versatile in use, durable in construction, and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include an exemplary embodiment of the present invention and illustrate various objects and features of the article of wearing apparel.

Figure 1:
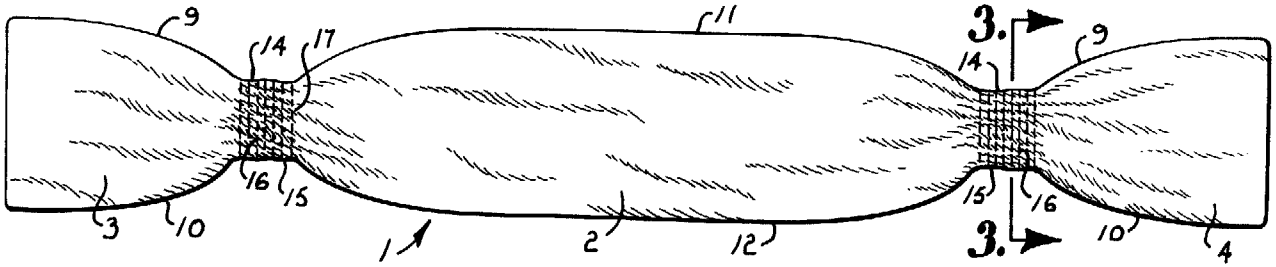
FIG. 1 is a top plan view of an article of wearing apparel embodying features of the present invention.
Figure 2:
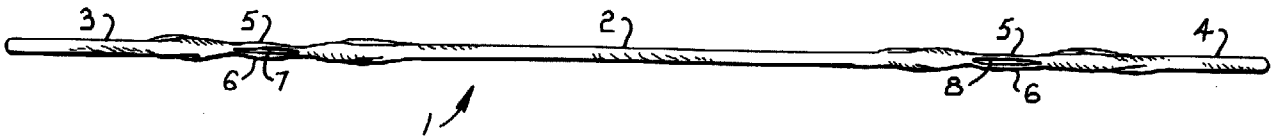
FIG. 2 is a side elevational view of the article of wearing apparel.
Figure 3:
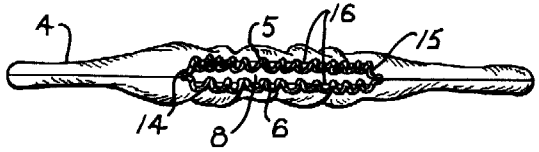
FIG. 3 is a transverse sectional view taken on line 3—3 of FIG. 1 and showing a transversely extending passage.
Figure 4:
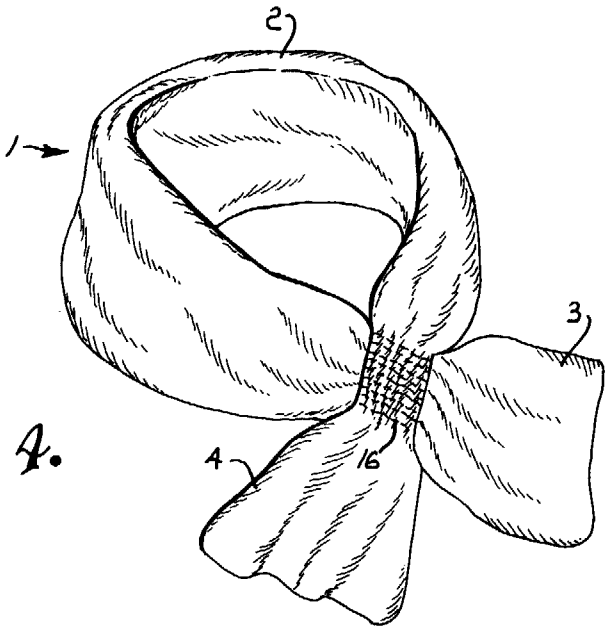
FIG. 4 is a perspective view of the article of wearing apparel shown in use as a scarf.

As required, detailed embodiments of the present invention are disclosed herein. However, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

Referring more in detail to the drawings:

In the disclosed embodiment of the present invention, the reference numeral 1 generally designates an article of wearing apparel adapted for use as a tie, scarf, neck-piece, hood, belt, or the like. The article of wearing apparel 1 is formed of an elongated fabric member having an intermediate portion 2 and opposite end portions 3 and 4 joined together by a respective pair of first and second fabric layers or portions 5 and 6 connected at spaced points to define first and second passages 7 and 8. The first and second fabric portions 5 and 6 of each pair are each of a width substantially less than a width of the intermediate portion 2 and the opposite end portions 3 and 4 whereby when one of the end portions, for example end portion 3, and the adjacent fabric portions 5 and 6 have been moved through the passage 6 adjacent the other end portion 4, the width of the end portion 3 provides resistance to being removed from the passage 6.

The fabric member forming the article 1 of wearing apparel is a generally rectangular member formed of either woven or non-woven fabric material including natural or synthetic fibers, plastic, leather, and the like. The end portions 3 and 4 each have opposite side edges 9 and 10 and the intermediate portion 2 has opposite side edges 11 and 12. When the article 1 is used as a scarf or neck-piece, the intermediate portion 2 has a length in the range of 16 to 22 inches, such that the article is free-moving and comfortable to wear around the neck of a person all without a feeling of strangulation.

The article 1 may be formed with a single transverse passage, however, in the illustrated embodiment, each pair of fabric portions 5 and 6 join a respective one of the end portions 3 and 4 to the intermediate portion 2. The fabric portions 5 and 6 each have opposite side edges 14 and 15. Each of the fabric portions have a spacing between the side edges thereof defining a width substantially less than a spacing between the opposite side edges 9 and 10 of the intermediate portion 2 and the opposite side edges 11 and 12 of the opposite end portions 3 and 4 whereby when one of the end portions of the fabric member has been moved through the passage adjacent the other end portion for use, the fabric portions provide resistance to pulling of the one end portion through said passage.

The length and width of the fabric portions 5 and 6 are substantially equal such that one pair of fabric portions are received between the other pair of fabric portions when the article 1 is in use. The length of the fabric portions 5 and 6 is approximately one-half the width of the end portions 3 and 4.

In the illustrated structure, each of the fabric portions 5 and 6 have a plurality of folds or gathers 16 retained in folded position by suitable stitching 17 or are knitted to provide the reduced width of the passages with a resistance to movement of the other end portion therethrough. The thickness of the article 1 at the fabric portions 5 and 6 is substantially greater than at the intermediate portion 2 and the end portions 3 and 4. The width of each of the fabric portions 5 and 6 is approximately one-half the width of the intermediate portion 2 and the end portions 3 and 4.

The fabric member preferably is knitted and of a single thickness, however, the fabric member may be formed of two layers of fabric in facing relation and joined at the ends and sides to define the intermediate portion 2 and the end portions 3 and 4. With the knitted structure the process is such that at the passages, the knitting forms two layers that define the passage therebetween with the passages extending transversely of the width of the fabric members.

In using an article of wearing apparel constructed as illustrated and described, the intermediate portion 2 is placed around the neck of a person. One of the end portions, for example end portion 3, is moved through the passage 8 adjacent the other end portion 4 until the fabric portions 5 and 6 adjacent the one end portion 3 is within the passage 8. The article resembles a knot at the point where the fabric portions 5 and 6 adjacent the one end portion 3 are in the passage 8 adjacent the other end portion 4. The ends and side edges 14 and 15 of the fabric portions 5 and 6 define abutments or shoulders to force the one end portion 3 to fold before being moved through the passage 8. Such resistance is sufficient to retain the article of wearing apparel around the neck of a person during normal body movements.

Figure 6:
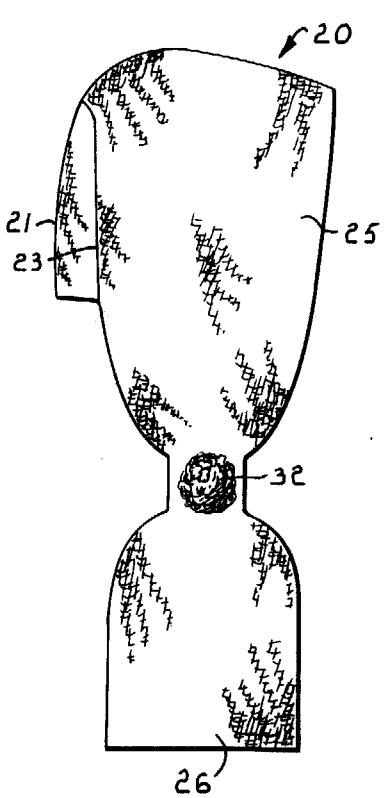
FIG. 6 is a side elevational view of the modified article of wearing apparel.
Figure 5:
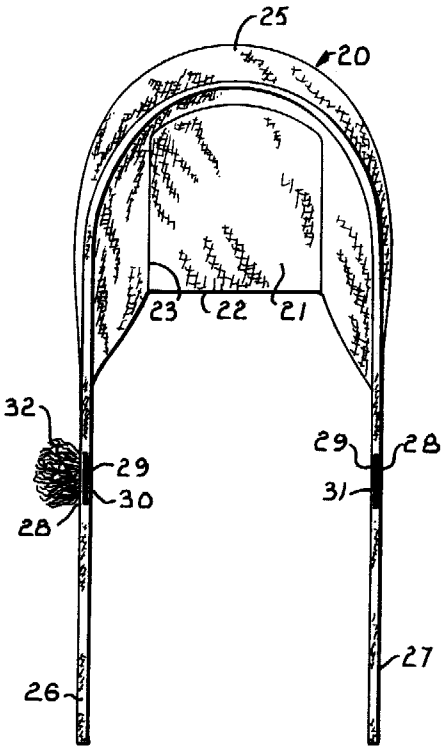
FIG. 5 is a front elevational view of a modified article of wearing apparel for use as a hood.
Figure 7:
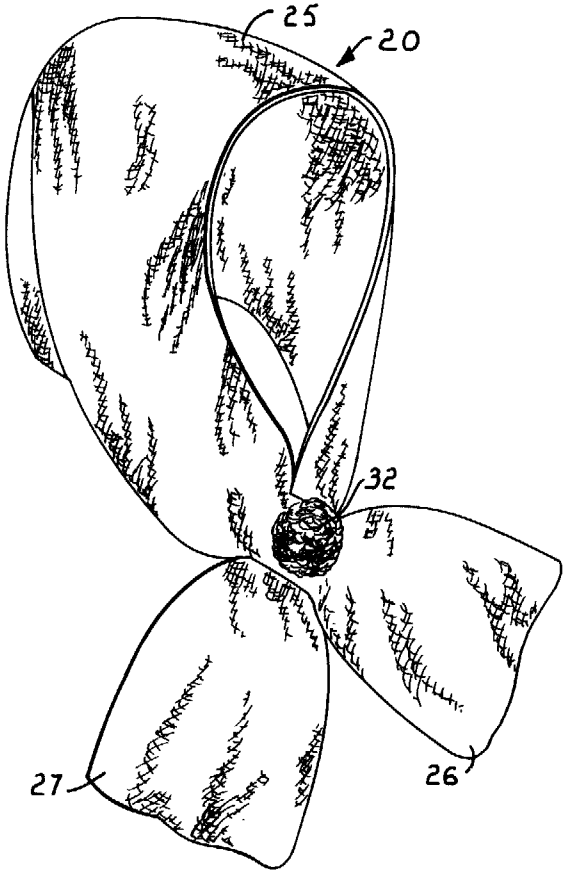
FIG. 7 is a perspective view of the modified article of wearing apparel shown in use.

FIGS. 5 to 7 inclusive illustrate a modified article 20 of wearing apparel having a fabric panel 21 engageable with a back portion of a head of a wearer. The fabric panel 21 has an end edge 22 and a side edge 23 joined to one side edge 24 of an intermediate portion 25 of a fabric member thereby defining a hood. The fabric member of the modified article 20 includes opposite end portions 26 and 27 joined to the intermediate portion 25 by a respective pair of facing fabric portions 28 and 29 thereby defining first and second passages 30 and 31.

The modified article 20 is preferably formed of knitted material with the fabric panel 21, intermediate portion 25, and end portions 26 and 27 formed of single knitted material and the fabric portions 28 and 29 of each pair of fabric portions are formed of double knitted material.

The intermediate portion 25 is preferably of a length in the range of 14 to 22 inches long. The intermediate portion 25 and the end portions 26 and 27 each have a width of approximately twice the width of each of the fabric portions of each pair of fabric portions 28 and 29. The length and width of the fabric portions of each pair of fabric portions are substantially equal such that one pair of fabric portions are received between the other pair of fabric portions when the article is in use.

The modified article 20 may have decorative items mounted thereon, such as a ball 32 mounted on the exterior fabric portion of one of the passages, so that the same is exposed when the article 20 is in use.

Use of the modified article is substantially similar to use of the article illustrated in FIGS. 1 to 4 inclusive, except that the intermediate portion 25 and the fabric panel 21 are placed in engagement with the head of a wearer and then the one end portion and adjacent fabric portions are moved through the passage defined by the fabric portions adjacent the other end portions.

It is to be understood that while we have illustrated and described certain forms of our invention, it is not to be limited to these specific forms or arrangement of parts herein described and shown.

We claim:

1. An article of wearing apparel comprising:

a. an elongated fabric member having an intermediate portion and opposite end portions, said fabric member having opposed side edges;

b. first and second facing fabric layers, a pair of fabric layers extending between a respective one of the opposite end portions and the intermediate portion of said fabric and connected at spaced points to define a passage, said pair of fabric layers each having opposed side edges having a spacing therebetween less than a spacing between the opposite side edges of said fabric member whereby when the other of the end portions of said fabric member have been moved through the passage adjacent the said end portion for use, said fabric portions provide resistance to pulling of said other end portion through said passage; and c. a fabric panel having an end edge and a side edge, said fabric panel side edge being joined to said fabric member at one of said side edges thereof in a manner such that said fabric panel and the intermediate portion of said fabric member define a hood.

2. An article of wearing apparel comprising:

a. an elongated fabric member having an intermediate portion and opposite end portions, said fabric member having opposed side edges;

b. first and second facing fabric layers, a pair of fabric layers extending between a respective one of the opposite end portions and the intermediate portion of said fabric and connected at spaced points to define a passage, said pair of fabric layers each having opposed side edges having a spacing therebetween less than a spacing between the opposite side edges of said fabric member whereby when the other of the end portions of said fabric member has been moved through the passage adjacent the said end portion for use, said fabric portions provide resistance to pulling of said other end portion through said passage age; and c. a pair of fabric layers extending between the other end end portion and the intermediate portion and connected at spaced points to define a second passage;

d. said fabric member being formed of knitted material;

e. said fabric layers between the intermediate portion and the opposite end portions being formed of double knitted material to define said first and second passages; and f. a fabric panel formed of knitted material and having an end edge and a side edge, said fabric panel side edge being joined to said fabric member at one of the side edges thereof in a manner such that said fabric panel and the intermediate portion of said fabric member define a hood.

3. An article of wearing apparel as set forth in claim 2 wherein the intermediate portion of said fabric member has a length in the range of 14 to 22 inches.

4. An article of wearing apparel as set forth in claim 2 wherein the spacing between the opposite side edges of said fabric member is approximately twice the spacing between the opposite side edges of said fabric layers.

5. An article of wearing apparel comprising:

a. an elongated fabric member having an intermediate portion and opposite end portions, said fabric member having opposite side edges;

b. first and second pair of facing fabric portions, each pair of facing fabric portions extending between a respective one of the opposite end portions and the intermediate portion of said fabric member to define first and second passages, said fabric portions of said first and second fabric portions each having opposite side edges having a spacing therebetween less than the spacing between the opposite side edges of said fabric member, said fabric portions of said first and second fabric portions each having a length substantially less than the spacing between the opposed side edges of said fabric member end portions whereby when one of the end portions of said fabric member has been moved through the passage adjacent the other end portion for use, said fabric portions provide resistance to pulling of said one end portion through said passage;

c. the intermediate portion of said fabric member having a length in the range of 14 to 22 inches;

d. the spacing between the opposite side edges of said fabric member being approximately twice the spacing between the opposite side edges of said fabric portions; and e. a fabric panel having an end edge and a side edge, said fabric panel side edge being joined to said fabric member at one of the side edges thereof in a manner such that said fabric panel and intermediate portion of said fabric member define a hood.

* * * * *